US009296979B1

(12) United States Patent
Kuo et al.

(10) Patent No.: US 9,296,979 B1
(45) Date of Patent: Mar. 29, 2016

(54) FLOWER ESSENTIAL OIL EXTRACTION METHOD

(71) Applicant: METAL INDUSTRIES RESEARCH & DEVELOPMENT CENTRE, Kaohsiung (TW)

(72) Inventors: Tzu-Chen Kuo, Kaohsiung (TW); Chi-Hui Chen, Kaohsiung (TW); Tung-Ping Lee, Kaohsiung (TW); Chun-Hung Hung, Kaohsiung (TW); Ho-Chung Fu, Kaohsiung (TW)

(73) Assignee: METAL INDUSTRIES RESEARCH & DEVELOPMENT CENTRE, Kaohsiung (TW)

( * ) Notice: Subject to any disclaimer, the term of this patent is extended or adjusted under 35 U.S.C. 154(b) by 0 days.

(21) Appl. No.: 14/569,323

(22) Filed: Dec. 12, 2014

(51) Int. Cl.
*C11B 1/00* (2006.01)
*C11B 9/02* (2006.01)

(52) U.S. Cl.
CPC ..... *C11B 9/025* (2013.01)

(58) Field of Classification Search
CPC ..... C11B 9/025
USPC ..... 554/20; 426/651
See application file for complete search history.

(56) References Cited

U.S. PATENT DOCUMENTS 5,405,633 A 4/1995 Heidlas et al.

FOREIGN PATENT DOCUMENTS

| | | | |
|---|---|---|---|
| CN | 1428408 | A | 7/2003 |
| CN | 102899170 | A | 1/2013 |
| CN | 103305344 | A | 9/2013 |
| WO | WO 02/04580 | | 1/2002 |

OTHER PUBLICATIONS

Notice of Allowance and Search Report issued on Jul. 17, 2015 by Taiwan Patent Office vfor the corresponding Taiwan Patent Application No. 103135718.
English translation of the Search Report issued on Jul. 17, 2015 by Taiwan Patent Office vfor the corresponding Taiwan Patent Application No. 103135718.
English abstract translation of CN103305344A.
English abstract translation of CN1428408A.
English abstract translation of CN102899170A.

*Primary Examiner* — Deborah D Carr
(74) *Attorney, Agent, or Firm* — WPAT, P.C.; Anthony King

(57) ABSTRACT

The present disclosure provides a flower essential oil extraction method. The flower essential oil extraction method includes (a) placing flowers in a high-pressure treatment tank; (b) introducing pressurized liquid medium into the high-pressure-treatment tank so as to reach a predetermined pressure, wherein the pressure is maintained for a predetermined period of time at a predetermined temperature, then the pressure is reduced to atmospheric pressure; and (c) placing the flowers subjected to high-pressure treatment in an extraction tank, wherein flowers are extracted with a low-polarity solvent to obtain an extract. By using the flower essential oil extraction method of the present disclosure, the flowers do not need to be subjected to a dehydration process, thus the energy cost is reduced, and more ingredients can be retained. Additionally, the flower essential oil extraction method of the present disclosure can reduce the energy consumption of drying and extraction so as to effectively reduce the manufacturing costs, thereby improving the industry competitiveness.

11 Claims, 1 Drawing Sheet

FLOWER ESSENTIAL OIL EXTRACTION METHOD

BACKGROUND OF THE DISCLOSURE

1. Field of the Disclosure

The disclosure relates to a flower essential oil extraction method.

2. Description of the Related Art

Due to high water content of flowers, it is difficult to preserve flowers. Flowers will gradually brown and lose its original fragrance after being picked, and even an undesirable odor is generated. According to a conventional extraction method, flowers are subjected to dehydration treatment such as drying or salting, but unstable substances such as low-boiling point fragrance, heat-sensitive or water-soluble ingredients will be lost or changed accordingly.

SUMMARY OF THE DISCLOSURE

The present disclosure provides a flower essential oil extraction method. The flower essential oil extraction method includes (a) placing flowers in a high-pressure treatment tank; (b) introducing pressurized liquid medium into the high-pressure treatment tank so as to reach a predetermined pressure, wherein the pressure is maintained for a predetermined period of time at a predetermined temperature, then the pressure is reduced to atmospheric pressure; and (c) placing the flowers subjected to high-pressure treatment in an extraction tank, wherein flowers are extracted with a low-polarity solvent to obtain an extract.

By using the flower essential oil extraction method of the present disclosure, the flowers do not need to be subjected to a dehydration process, thus the energy cost is reduced, and more ingredients can be retained. Furthermore, the flower essential oil extraction method of the present disclosure breaks through the technical bottleneck that flowers have to be dried in advance due to high water content or the problem of subsequent oil-water separation in conventional flower extraction methods, so that the process can be simplified and the process time can be shortened. Additionally, the flower essential oil extraction method of the present disclosure can reduce the energy consumption of drying and extraction so as to effectively reduce the manufacturing costs, thereby improving the industry competitiveness.

DETAILED DESCRIPTION OF THE DISCLOSURE

Figure 1:
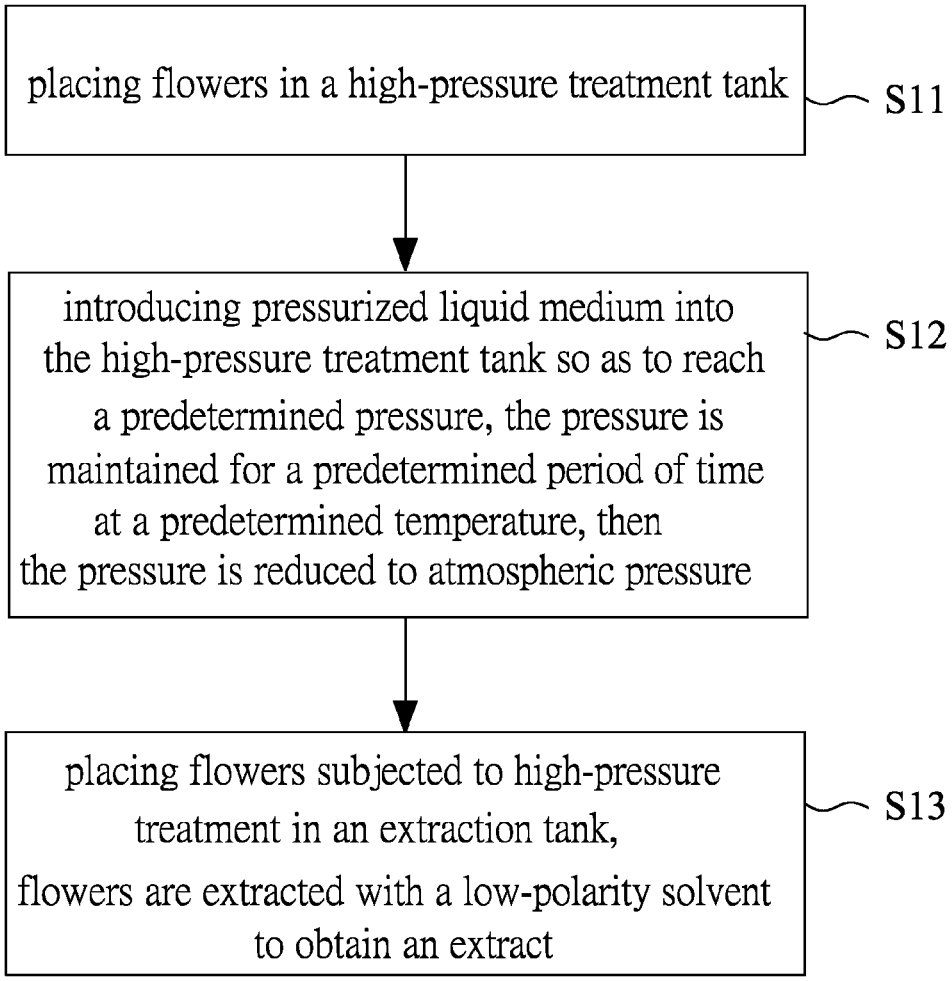
FIG. 1 is a schematic flowchart of a flower essential oil extraction method of the present disclosure.

FIG. 1 is a schematic flowchart of a flower essential oil extraction method of the present disclosure. Referring to Step S11, flowers are placed in a high-pressure treatment tank. In an embodiment, *magnolia* flowers in bloom are selected, the water content of the flowers is greater than 50% (for example, the water content is 86%). Browning flowers are screened out, and also the receptacle, the calyx and the bud are removed. Fresh *magnolia* petals are selected. The fresh *magnolia* petals are placed in a high-pressure treatment tank. In an embodiment, the fresh *magnolia* petals can be directly placed in the high-pressure treatment tank, or the fresh *magnolia* petals are placed in a container, and then the container with the fresh *magnolia* petals is placed in the high-pressure treatment tank.

The container is made of a soft material capable of producing corresponding deformation when being compressed, for example, the container may be a PE bag. In an embodiment, the flowers may be soaked with a liquid introduced into the container. The soaking liquid may be pure water, and has a volume of about 500 ml.

Referring to Step S12, a pressurized liquid medium is introduced into the high-pressure treatment tank so as to reach a predetermined pressure, wherein the pressure is maintained for a predetermined period of time at a predetermined temperature, and then the pressure is reduced to atmospheric pressure. A pressurized liquid medium includes one or a combination of several of water, alcohol, and vegetable oil. The predetermined pressure may be 10 to 600 MPa, the predetermined period of time may be 5 to 60 minutes, the predetermined temperature may be around room temperature, and pressurization and depressurization can be repeated at least once. In an embodiment, at room temperature, a hydrostatic pressure of 100 MPa is applied to the high-pressure treatment tank and is maintained for 10 minutes. Then the pressure is reduced to atmospheric pressure. The above processes are repeated three times. In this step, by means of pressure, cells of the flowers are destroyed, so that fragrance ingredients in the flowers are easily released, and the subsequent extraction effect is improved. If the fresh *magnolia* petals are not placed in any container and are directly placed in the high-pressure treatment tank, the pressurized liquid medium in the high-pressure treatment tank has the *magnolia* fragrance and can be utilized. If the fresh *magnolia* petals are placed in a container and are soaked with a liquid in the container, the soaking liquid in the container has the *magnolia* fragrance and can be utilized.

Referring to Step S13, the flowers subjected to high-pressure treatment are placed in an extraction tank and are extracted with a low-polarity solvent to obtain an extract. The low-polarity solvent includes n-hexane, propane, butane, carbon dioxide, dimethyl ether and petroleum ether. In an embodiment, liquefied propane is used as the extraction agent, and liquefied propane is introduced into the extraction tank from the lower part for extraction. Dynamic extraction, static extraction or a combination thereof is adopted, where the static extraction time is 0 to 4 hours, and the dynamic extraction time is 0 to 4 hours. As for static extraction, after liquefied propane is introduced, a fixed amount of liquefied propane interacts with the flowers at a predetermined temperature for a predetermined period of time; as for dynamic extraction, liquefied propane is continuously introduced to continuously flow through the flowers. The operating pressure of the extraction tank is 2 to 10 MPa, and the operating temperature thereof is 15 to 40° C. In an embodiment, the operating pressure of the extraction tank is 4 MPa, the operating temperature thereof is 25° C., and a combination of dynamic extraction and static extraction is adopted. Because the solubility of liquefied propane in water is very low, the extraction is not influenced by the high water content of flowers.

In an embodiment, liquefied propane and the extract are obtained from the upper part of the extraction tank, that is, the extract is carried out by liquefied propane and is carried to a depressurization and separation tank, so that liquefied propane is converted into gaseous propane, and gaseous propane can be separated from the extract.

Due to the properties that liquefied propane has a high solubility for low-polarity ingredients such as essential oil and gaseous propane has a reduced solubility, the extract and propane can be easily separated after extraction. At the same operating pressure and operating temperature, the solubility of liquefied propane for oil is 10 to 100 times higher than that for carbon dioxide, so the operating pressure of liquefied propane can be reduced to 5 MPa or less, thereby significantly decreasing the equipment costs, which is beneficial to commercialization.

Due to very low solubility of propane in water, the water in the flowers will not be carried out by propane, so the extract does not have the problem of oil-water separation. Additionally, due to the anaerobic operating environment, the extract has distinct flower fragrance and can be directly used as a flower extractum product, and can also be further separated and purified, to obtain various flower fragrance related products.

According to the flower essential oil extraction method of the present disclosure, by treating the flowers with or without a soaking liquid under room temperature and high pressure in advance, the subsequent extraction yield of essential oil can be improved. Moreover, the soaking liquid after treatment can be directly used as a cosmetic additive; or trace essential oil ingredients in the soaking liquid after treatment can be further extracted and may be mixed with the propane extract, so as to retain more flower ingredients.

The present disclosure is described below in detail with the following examples, but it does not mean that the present disclosure is merely limited to the disclosure of these examples.

Example 1

*Magnolia* flowers in bloom (for example, the water content is 85%) were selected, browning flowers were screened out. The receptacle, the calyx and the bud were removed, and 700 g of fresh *magnolia* petals were placed in a PE bag. 500 ml of pure water was added, and the PE bag is sealed after air in the bag is exhausted.

The PE bag containing the 700 g of fresh *magnolia* petals and the 500 ml of pure water was placed in a high-pressure treatment tank, and preferably, a hydrostatic pressure of 100 to 400 MPa was applied at room temperature. In this embodiment, a pressurized liquid medium was water and a hydrostatic pressure of 100 MPa was applied at room temperature, the pressure was maintained for 10 minutes, and then was reduced to atmospheric pressure. The above processes were repeated three times. The PE bag was taken out from the high-pressure treatment tank, water with flower fragrance in the PE bag was poured out. Additionally, wet petals were transferred into an extraction tank (2 L).

Liquefied propane was introduced into the extraction tank from the lower part, the extraction pressure of the extraction tank was 4 MPa, the extraction temperature was 25° C., and a combination of dynamic extraction and static extraction was adopted. The extract was carried out by liquefied propane from the upper part of the extraction tank and was carried to a depressurization and separation tank, so as to separate gaseous propane from the extract. As a result, 0.34 g of orange water-free extract with distinct *magnolia* fragrance was collected. The extraction yield of the water-free extract is 0.32% (w/w dry weight), and the extract contains 37 fragrance ingredients determined by GCMS fragrance analysis, and the content of main fragrance ingredients is improved by 34%. Additionally, the water poured out from the PE bag contains the main fragrance ingredients determined by GCMS fragrance analysis. Finally, *magnolia* flowers in the extraction tank were taken out, and were wet without browning.

Example 2

*Magnolia* flowers in bloom (for example, the water content is 85%) were selected, browning flowers were screened out. The receptacle, the calyx and the bud were removed, and 700 g of fresh *magnolia* petals were placed in a PE bag. The PE bag is sealed after air in the bag is exhausted.

The PE bag containing the 700 g of fresh *magnolia* petals was placed in a high-pressure treatment tank, and preferably, a hydrostatic pressure of 100 to 400 MPa was applied at room temperature. In this embodiment, a pressurized liquid medium was water and a hydrostatic pressure of 100 MPa was applied at room temperature, the pressure was maintained for 10 minutes, and then was reduced to atmospheric pressure. The above processes were repeated three times. The PE bag was taken out from the high-pressure treatment tank. Additionally, wet petals were transferred into an extraction tank (2 L).

Liquefied propane was introduced into the extraction tank from the lower part, the extraction pressure of the extraction tank was 4 MPa, the extraction temperature was 25° C., and a combination of dynamic extraction and static extraction was adopted. The extract was carried out by liquefied propane from the upper part of the extraction tank and was carried to a depressurization and separation tank, so as to separate gaseous propane from the extract. As a result, 0.37 g of orange water-free extract with distinct *magnolia* fragrance was collected. The extraction yield of the water-free extract is 0.35% (w/w dry weight). Finally, *magnolia* flowers in the extraction tank were taken out, and were wet without browning.

By using the flower essential oil extraction method of the present disclosure, the flowers do not need to be subjected to a dehydration process, thus the energy cost is reduced, and more ingredients can be retained. Furthermore, the flower essential oil extraction method of the present disclosure breaks through the technical bottleneck that flowers have to be dried in advance due to high water content or the problem of subsequent oil-water separation in conventional flower extraction methods, so that the process can be simplified and the process time can be shortened. Additionally, after treatment by the hydrostatic pressure in the high-pressure treatment tank, cells of the *magnolia* petals can be destroyed, thereby significantly improving the yield of subsequent extraction. Therefore, the flower essential oil extraction method of the present disclosure can reduce the energy consumption of drying and extraction so as to effectively reduce the manufacturing costs, thereby improving the industry competitiveness.

While several embodiments of the present disclosure have been illustrated and described, various modifications and improvements can be made by those skilled in the art. The embodiments of the present disclosure are therefore described in an illustrative but not in a restrictive sense. It is intended that the present disclosure should not be limited to the particular forms as illustrated and that all modifications which maintain the spirit and scope of the present disclosure are within the scope defined in the appended claims.

What is claimed is:

1. A flower essential oil extraction method comprising:

(a) placing flowers in a high-pressure treatment tank;

(b) introducing pressurized liquid medium into the high-pressure treatment tank so as to reach a predetermined pressure, wherein the pressure is maintained for a predetermined period of time at a predetermined temperature, then the pressure is reduced to atmospheric pressure; and (c) placing the flowers subjected to high-pressure treatment in an extraction tank, wherein flowers are extracted with a low-polarity solvent to obtain an extract.

2. The flower essential oil extraction method according to claim 1, wherein the water content of the flowers is greater than 50%.

3. The flower essential oil extraction method according to claim 1, wherein in the step (a), further comprising a step of placing flowers in a container.

4. The flower essential oil extraction method according to claim 3, further comprising a step of introducing liquid into the container and make the flowers soaked with the liquid.

5. The flower essential oil extraction method according to claim 1, wherein in the step (b), the pressurization and depressurization repeat at least once, and the predetermined period of time is 5 to 60 minutes.

6. The flower essential oil extraction method according to claim 1, wherein in the step (b), the pressure of the pressurized liquid medium is 10 to 600 MPa.

7. The flower essential oil extraction method according to claim 1, wherein the low-polarity solvent comprises n-hexane, propane, butane, carbon dioxide, dimethyl ether and petroleum ether.

8. The flower essential oil extraction method according to claim 7, wherein in the step (c), liquefied propane is used for extraction.

9. The flower essential oil extraction method according to claim 8, wherein in the step (c), dynamic extraction, static extraction or a combination thereof is adopted, where the static extraction time is 0 to 4 hours, and the dynamic extraction time is 0 to 4 hours.

10. The flower essential oil extraction method according to claim 8, wherein the operating pressure of the extraction tank is 2 to 10 MPa, and the operating temperature thereof is 15 to 40° C.

11. The flower essential oil extraction method according to claim 8, wherein in the step (c), further comprising a separation step, liquefied propane and the extract are introduced into a depressurization and separation tank to separate gaseous propane and the extract.

* * * * *